United States Patent [19]

Ekerot

[11] Patent Number: 4,479,530

[45] Date of Patent: Oct. 30, 1984

[54] METHOD OF MANUFACTURING METALLIC WIRE PRODUCTS BY DIRECT CASTING OF MOLTEN METAL

[76] Inventor: Sven T. Ekerot, Box 2751, SE-761 00 Norrtälje, Sweden

[21] Appl. No.: 341,987

[22] PCT Filed: May 8, 1981

[86] PCT No.: PCT/SE81/00139

§ 371 Date: Jan. 8, 1982

§ 102(e) Date: Jan. 8, 1982

[87] PCT Pub. No.: WO81/03136

PCT Pub. Date: Nov. 12, 1981

[30] Foreign Application Priority Data

May 8, 1980 [SE] Sweden ..... 8003487

[51] Int. Cl.[3] ..... B22D 19/08

[52] U.S. Cl. ..... 164/461; 164/486

[58] Field of Search ..... 164/461, 268, 466, 502, 164/147.1, 498, 500

[56] References Cited

U.S. PATENT DOCUMENTS

| | | | |
|---|---|---|---|
| 2,970,830 | 2/1961 | Siegfried | 164/498 X |
| 3,060,055 | 10/1962 | Bixler | 164/461 |
| 3,470,939 | 10/1969 | Coad | 164/461 X |
| 3,842,896 | 10/1974 | Dobo | 164/461 |

FOREIGN PATENT DOCUMENTS

| | | | |
|---|---|---|---|
| 44-29362 | 11/1969 | Japan | 164/461 |
| 54-71039 | 6/1979 | Japan | 164/461 |
| 582042 | 11/1977 | U.S.S.R. | 164/461 |

*Primary Examiner*—Kuang Y. Lin

*Attorney, Agent, or Firm*—Silverman, Cass & Singer

[57] ABSTRACT

A coating of metal is applied to a metal wire having substantially the same melting point as the metal coating. The wire is passed through a bath of molten metal contained in a container and out through an outlet hole in the container bottom. The diameter-like dimension of the hole is 1.5 to 2 times the like dimension of the wire so that molten metal flows down through the outlet hole along the wire. The wire and molten metal then are cooled to solidify the coating on the wire.

4 Claims, 6 Drawing Figures

METHOD OF MANUFACTURING METALLIC WIRE PRODUCTS BY DIRECT CASTING OF MOLTEN METAL

Figure 1:
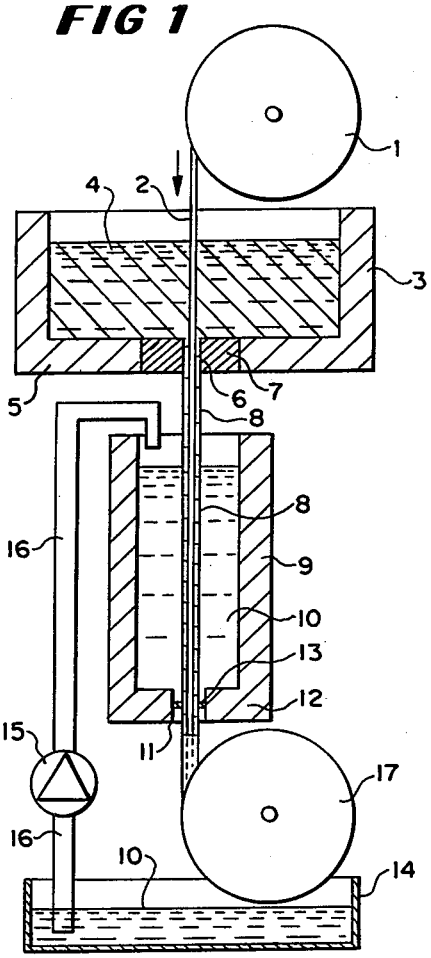

This invention relates to a method of manufacturing metallic wire products by direct casting, i.e. a method at which molten metal is caused to solidify directly to a wire-shaped product of substantial length, and a coat of metal is poured or applied on a metal wire. The invention also relates to an apparatus for carrying out the method.

At conventional metal wire manufacturing methods, where the term wire is understood to refer to a product having relatively small cross-sectional area and substantial length, a bath of the metal is cast batchwise to ingots or continuously to strands, which are divided transversely to their longitudinal direction into wire billets. The ingots and, respectively, billets have a cross-sectional area of about 10,000 $mm^2$ or more and are hot rolled in rolling mills to suitable cross-sectional dimensions, which for steel normally are round with a diameter of 5 to 9 mm. The wire thus produced is subjected to further treatment by being drawn in cold state.

The manufacturing method schematically described above is very expensive and involves material losses. The rolling mill equipment a.o. (among the things) is extensive, because the difference between the cross-sectional area of the starting material, i.e. ingots and, respectively, billets, and the cross-sectional area of the hot-rolled wire is great and requires a great number of passes. The material, besides, must have good machinability, which primarily depends on the analysis of the material and, therefore, implies restrictions from a material point of view.

A satisfactorily operating method of direct wire casting where a relatively small cross-section is cast substantially continuously, therefore, must offer a great number of obvious technical and economic advantages. At present no method exists by which the considerable technical problems involved in such a direct casting process have been solved, and, therefore, no method is applied in commercial production either.

One known tested method of direct casting is the Michelin process, at which a jet of molten metal is pressed out at high pressure through a small aperture, nozzle, whereby under favourable conditions a wire of about 0.2 mm diameter can be formed.

By maintaining a high silicium content in the bath and by surrounding the jet with an oxygen gas atmosphere, according to Michelin an oxide shell is formed which holds the jet together until it has solidified. The method, which so far has been tested only on a laboratory scale, is very difficult to control. It, further, permits production of only very thin wire and requires high silicium contents in the wire material.

Other direct casting methods have been tested, at which primarily a rapidly solidifying structure of the wire is desired. In these cases very small dimensions are desired, and promising results have been obtained on a laboratory scale with alloys having a low liquidus temperature, i.e. temperature of commencing solidification. Due to the small dimensions, however, these methods are without interest from a production aspect for "normal" products and material types.

Methods for the manufacture of steel fibres from a molten bath are known and have been developed close to commercial production. At these methods a wheel is rotated so that a portion of its periphery is immersed in the bath. It was, however, found unfeasible to manufacture in this way a coherent wire with acceptable cross-section.

A further method known is "dip forming", which is used for applying a very pure outer coat of copper on copper wire. It was found possible by this method to "freeze on" a coat on a wire by dipping the wire into a molten bath of the same material as the wire. For technical reasons, however, this method is not adapted for use on steel. The method rather is to be regarded as a method of surface coating.

Conclusively one may say, that in spite of the obvious technical and economic advantages implied in the direct casting of steel wire products, no working method is yet available.

In principle, the simplest method of manufacturing wire by direct casting should be to cause the molten metal to flow out through an opening, a so-called nozzle, of a container and thereby to form a coherent jet intended to solidify to a wire. It involves, however, problems unsolved so far how to cause such a jet to solidify to wire of desired dimensions. Due to the high surface tension of the steel, a strong tendency of breaking-up the jet into droplets arises, because from an energetic aspect the form of droplets is more favorable for the bath. This tendency further is favored by requirements on decreasing diameters, owing to the accelerating effect of gravity on the jet in combination with requirements on constant volume.

The present invention relates to a simple solution of the aforesaid problems in connection with the outflow of molten metal, where a wire continuously runs out through said opening or nozzle. The wire is enclosed by the molten metal in the jet and stabilizes the jet for so long a period as required by the molten metal to solidify, whereby a continuous wire is obtained, the diameter of which exceeds the diameter of the wire running-out, supplied. The process can be controlled by adjusting a.o. the height of the molten metal, i.e. the bath depth, the running-out rate of the wire and the temperature of the bath.

The present invention, thus, relates to a method of manufacturing metallic wire products by the direct casting of molten metal, which in form of a bath is contained in a container, casting box or the like, and molten metal in the form of a jet is caused to freely flow out through an outflow hole in the bottom of the container.

The method is characterized in that the jet flowing out through the outflow hole is stabilized by means of a wire of a metal having substantially the same melting point as the metal in the bath, that the diameter or corresponding dimension of the outflow hole is substantially, preferably 1.5 to 2 times greater than the diameter of corresponding dimension of the wire, and that the wire is transported at least at a rate corresponding substantially to the rate of the molten metal flowing through the outflow hole, whereafter the wire and the molten metal surrounding the wire are cooled and collected.

The invention also relates to an apparatus for carrying out the method as defined in the attached claims.

The apparatus is characterized in that a container, casting box or the like includes a bath of molten metal, that an uncoiling reel is located above or on the same level as the container, from which reel the wire is intended to run and be introduced into the container, that in the bottom of the container or casting box an outlet hole is located, the diameter or corresponding dimension of which exceeds the diameter or corresponding dimension of the wire and preferably is 1.5 to 2 times greater, through which outlet hole the wire is intended to be pressed out of the container, and through which outlet hole molten metal in the container is intended to flow out along the wire, that a cooling device is provided to cool the molten metal flown out so that it solidifies to a coat on the wire, and that a coiling reel is provided for coiling the wire with the solidified coat.

Figure 2:
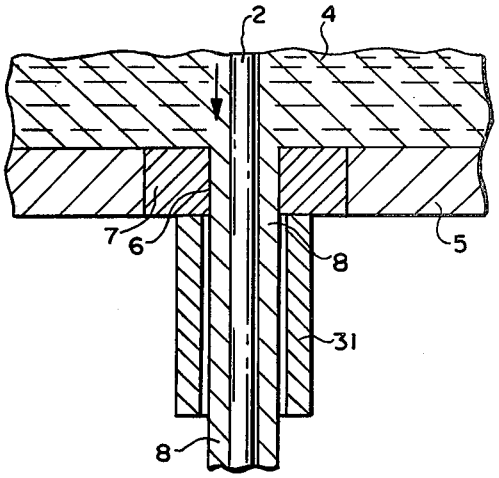
Figure 3:
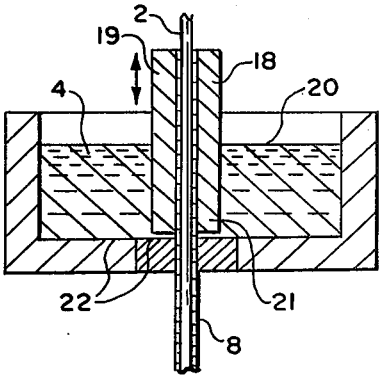

The invention is described in greater detail in the following, with reference to the accompanying drawings, in which FIG. 1 is a vertical section through a schematically shown first embodiment of an apparatus for carrying out the invention, FIG. 2 is a vertical section through an outlet hole, nozzle, of the apparatus according to FIG. 1, shown in greater detail, FIG. 3 is a vertical section through a schematically shown portion of a second embodiment of an apparatus for carrying out the method according to the invention.

Figure 4:
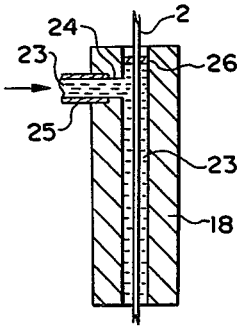
Figure 5:
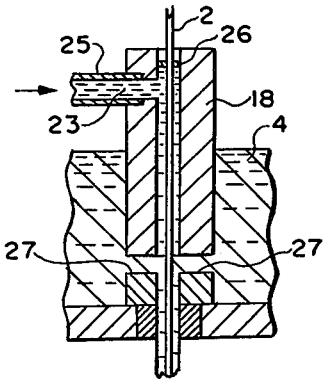
Figure 6:
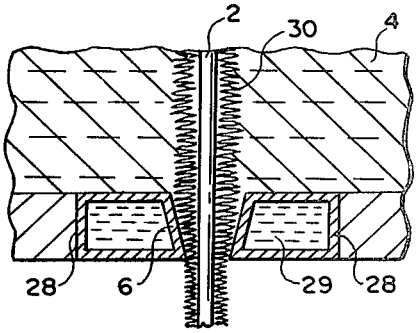

FIG. 4 is a vertical section through a schematically shown portion of a third embodiment of an apparatus for carrying out the method according to the invention, FIG. 5 is a vertical section through a schematically shown portion of a fourth embodiment of an apparatus for carrying out the method according to the invention, FIG. 6 is a vertical section through a schematically shown second embodiment of an outlet opening according to the invention.

In FIG. 1 the numeral 1 designates an uncoiling reel or the like, from which a metal wire 2 is to run off. The uncoiling or supply reel 1 may be a wire magazine, but may also be a block, to which wire from a magazine is taken and intended to run off from the block.

Preferably beneath or on the same level as the uncoiling reel 1 a container 3, a so-called casting box 3 or the like, is located which is intended to hold a bath 4 of molten metal to be applied on the wire 2. In the bottom 5 of the container 3 an outlet hole 6 for molten metal is located, for example in a so-called nozzle 7 or the like, which nozzle consists, for example, of a perforated ceramic insert 7 in the bottom 5 of the container 3.

The wire 2 is intended to be introduced into the bath 4, to be passed therethrough and out of the bath 4 and container 3 through the outlet hole 6, which has a diameter or corresponding dimension exceeding substantially the diameter or corresponding dimension of the wire 2. Thus, molten metal is intended to flow out of the bath 4 through the outlet hole 6 along the wire 2 and to form a coat 8 about the wire 2.

Preferably beneath the container 3 a cooling device is provided which substantially comprises a container 9 or the like with a coolant 10, such as a liquid or melt. Through said coolant 10 the wire 2 with the coat 8 of molten metal flown-out is intended to be passed. In many cases a coolant is preferred which at the contact with the coat does not vaporize.

The container 9 is arranged in a way suitable for the purpose, for example upwardly open and having a hole 11 in its bottom 12 where preferably a sealing 13 of a suitable kind is located in connection to the hole 11 for sealing against the wire 2 with the coat 8, as appears from FIG. 1.

The cooling device 9,10 preferably is designed for circulation of coolant 10 by means of a collecting container 14 and a return conduit 16 provided with a pump 15, as schematically indicated in FIG. 1.

The wire 2 with said coat 8, after having passed through the cooling device 9,10, is coiled or take-up on a coiling reel 17. At this time the coat 8 is supposed to have solidified.

In FIG. 2 the outlet hole 6, nozzle 7 and wire 2 with coat 8 are shown in greater detail.

In FIG. 3, which refers to a second embodiment of an apparatus according to the invention and where the cooling device 9,10 is not shown, the numeral 18 designates a pipe or the like of, for example, ceramic material, which pipe 18 is immersed into said bath 4 of molten metal. The pipe 18 is located so that its upper mouth 19 preferably is located above the upper surface 20 of the bath 4, and its lower mouth 21 is located in connection to the outlet hole 6 in the bottom 5 of the container 3. Through said pipe 18 the wire 2 is intended to be introduced into the bath 4. The pipe 18 preferably can be lifted and lowered, and its lower mouth 21 preferably is designed and intended for sealing against the container 3 on the inside 22 thereof at said outflow hole 6, so that the outflow of molten metal from the bath 4 through the outlet hole 6 can be adjusted and/or shut off completely by means of said pipe 18.

The pipe 18 can be disposed and designed as shown in FIG. 4 where a coolant 23, such as liquid argon, is to be introduced into the pipe 18 and intended to cool the wire 2 at its passage through the pipe 18. The pipe 18 here is formed, for example, with an opening 24 close to its upper mouth 19, through which opening the coolant 23 can be supplied under pressure via a feed conduit 25. It is, of course, possible to provide several openings 24 and feed conduits 25. The numeral 26 designates a sealing between the wire and the pipe 18 at the upper mouth 19 of the pipe where the wire 2 is intended to be introduced.

The pipe may be designed as shown in FIG. 5 where radially directed holes 27 are located slightly above the lower mouth of the pipe, through which holes molten metal from the bath 4 is intended to be supplied to the pipe and wire.

In FIG. 6 showing a further embodiment of an outlet hole 6 the numeral 28 designates a cooling casing of, for example, copper located at the bottom 5 and intended to be flown through by a coolant 29, where the outlet hole 6 is a hole formed by the cooling casing 28 as shown in FIG. 6. The outlet hole 6 here preferably is substantially conic and tapering to the outer surface of the container 3, whereby it is possible to compress a coat 30, which already in the bath 4 has been frozen on the wire 2.

In connection to said outlet hole 6, irrespective of its specific design, means of known kind can be provided for the generation of magneto-hydrodynamic (MHD) force fields, for example as shown in FIG. 2, which fields are designated by 31. The MHD means are arranged so that the molten metal flowing out through the outlet hole 6 can be braked, and that generated braking force can be varied. The MHD means further contribute to quite solidification and a uniform surface of the solidified coat.

The apparatus according to the invention operates as follows.

The wire 2 to be applied with a coat of metal is passed from the uncoiling reel 1 down into the bath 4 of molten metal in the container 3, which metal is intended to be applied on the wire 2. The wire 2 thereafter is passed out of the bath 4 through the outlet hole 6 in the bottom 5 of the container 3. The outlet hole 6 has a diameter or corresponding dimension which substantially exceeds the diameter or corresponding dimension of the wire 2. Molten metal flows out through the outlet hole and along the wire, which acts coherently on the jet and prevents the jet from being broken-up into droplets.

The said jet constituting a coat of molten metal, thus, is applied on the wire where said coat will have a thickness depending a.o. on the diameter of the outlet hole in relation to the diameter of the wire.

The method includes the solidification of said molten metal coat, and, therefore, the temperature of the molten metal must be lowered, preferably by forced cooling, at first below the temperature for commencing cooling, the so-called liquidus temperature, and then below the temperature for complete solidification, the so-called solidus temperature.

The cooling is effected in several ways. The molten metal coat is cooled partly "from inside" the wire, provided that the wire has a lower temperature than the coat, and partly by surrounding medium, for example air, after the outflow out of the outlet hole. The main cooling, however, takes place when the wire is passed through the container 9 with coolant 10, where the coolant is a liquid, for example water or melt. The wire with applied solidified coat passes out through a hole provided with sealing in the container bottom, whereafter the wire with the coat is coiled by means of the coiling reel 17. Coolant possibly leaking is collected and returned to the container 9 when deemed suitable and possible. The necessary cooling effect of the cooling device varies with the volume to be cooled per time unit, i.e. with the coat thickness and rate of the wire. The cooling effect can be adjusted according to demand a.o. by varying the bath depth in the container, where said effect increases with the bath depth. It can also be imagined to pass the wire in some form of loop through the container whereby the staying time in the bath and thereby the cooling effect increases.

The cooling, of course, also can be carried out in several other ways. Liquid or gas, for example, may be sprayed against the wire. Also contact cooling can be imagined where the wire with the coat is passed between cooled rolls or the like. It is, of course, possible to combine several cooling methods.

Generally, it applies that the cooling must be adjusted so that the coat of molten metal has solidified substantially completely prior to the coiling. At a definite cooling effect, this implies restrictions with respect to coat thickness and wire rate.

Certain conditions or restrictions also are involved with the passage of the wire through the bath 4 of molten metal prior to the application of said coat of molten metal. The wire, for example, of course must not be caused to melt at the passage through the bath. When the material in the molten metal is the same as in the wire, the exposure time of the wire in the bath must be so short that the temperature of the wire cannot increase to the solidus temperature for the material. The exposure time can be reduced by increasing the wire rate, but then the cooling must be taken into consideration, because as mentioned before the requirements of cooling are higher the higher the wire rate is. The exposure time also may be reduced by shortening the distance through which the wire is passed through the bath. This preferably is brought about by introducing the wire into the bath beneath its surface and close to the outlet hole. This is the function of the pipe 18 at the embodiment shown in FIG. 3 where the lower mouth of the pipe is intended to be held close to the outlet hole, and the inner diameter of the pipe only insignificantly exceeds the diameter of the wire, so that molten metal does not arise in the pipe due to the small space between the wire and the inner wall of the pipe and due to the movement of the wire. This is also the main function of the pipe 18 at the embodiment shown in FIG. 4. According to this embodiment the wire is also cooled by the coolant 23, which for example consists of liquid argon. The coolant 23 is introduced into the pipe under pressure and prevents molten metal from arising in the pipe. The cooling of the wire reduces the risk of melting. This is also the main function of the embodiment according to FIG. 5 where the pipe slightly above its lower mouth is provided with the radially directed holes, through which molten metal from the bath is supplied to the pipe and wire. In a corresponding manner as at the embodiment shown in FIG. 4, the coolant is introduced into the pipe whereby molten metal is prevented from arising in the pipe at the same time as the wire is cooled.

The embodiment according to FIG. 6 refers to cases, i.e. to such process conditions, where freezing-on of metal on the wire is obtained already in the bath. The cooling casing 28 in this case is a tool, which a.o. by its conic shape tapering to the outside of the container and by choosing a sufficiently small diameter or corresponding dimension of its outlet opening compresses the freezed-on coat, i.e. reduces the coat thickness. At the same time, the coat and molten metal flowing out are cooled.

As indicated above, there exist, thus, a great number of possible combinations of conditions, under which said coat of molten metal can be applied and caused to solidify on the wire. Important parameters are a.o. the temperature of the wire, the liquidus and solidus temperatures of the wire, the temperature of the molten metal in the bath, the liquidus and solidus temperatures of the molten metal, the thermal diffusivity of the molten metal, the diameter of the outlet hole in relation to the wire diameter, the temperature of possible coolant and the heat transfer coefficient with respect to heat transfer between the coat and the coolant. Of great importance, of course, is also the rate at which the wire is passed through the bath and outlet hole, and the exposure time of the wire in the bath. Here also the height or depth of the bath has some effect under certain conditions.

Of great importance for the function of the process, of course, is the diameter or correspnding dimension of the outlet hole 6 in relation to the diameter or corresponding dimension of the wire 2. The thickness of the coat of molten metal being applied, namely, corresponds substantially to the difference between the radius of the outlet hole and the wire radius. Under definite conditions in general, there exists, of course, a limit for the thickness of the coat to be applied.

In the Table below examples of condition combinations are shown, under which the method can be carried out. It is characteristic of said combinations, that the temperature of the molten metal is held only slightly higher than the liquidus temperature of the molten metal, which facilitates the solidification, and that the wire rate and the thickness of the coat applied have been adjusted so that the reasonable requirements are raised on cooling after they have left the bath.

In the Table the terms as follows apply.

$\phi_t$=wire diameter (mm)
$\phi_u$=outlet hole diameter (mm)
v=wire rate (m/s)
$T_s$=temperature of molten metal in the bath (°C.)
$T_l$=liquidus temperature of the molten metal (°C.)

| Wire material | Molten metal material | $\phi_t$ (mm) | $\phi_u$ (mm) | v (m/s) | $T_s$ (°C.) | $T_l$ (°C.) |
|---|---|---|---|---|---|---|
| 1. Carbon steel SIS 2114 | Carbon steel SIS 2114 | 0.5 | 1.0 | 10 | 1535 | 1515 |
| 2. Carbon steel SIS 2114 | Stainless steel SIS 2343 | 1.0 | 2.0 | 5 | 1450 | 1420 |
| 3. Stainless steel SIS 2562 | Stainless steel SIS 2562 | 0.2 | 0.4 | 30 | 1450 | 1405 |

The rate of the wire 2 can be higher than the rate of the molten metal 8 through the outlet hole 6, whereby a thinner product is obtained than if the rate of the wire 2 would correspond to the rate of the molten metal.

The diameter of the outlet hole preferably is 1.5 to 2 times greater than the wire diameter. The proportions, however, can be varied within wide limits by varying the remaining parameters.

As will have become apparent from the aforesaid, the method according to the invention offers a solution of the problems involved with the direct casting of wire. The method provides excellent possibilities of controlling the casting process where the process conditions can be varied within wide limits.

It is apparent that several variants of the method and embodiments of the apparatus according to the invention can be imagined without abandoning the invention idea.

The material in the wire, for example, can be selected so that it has a solidus temperature, which exceeds or is close to the temperature of the molten metal, whereby the risk of wire melting is eliminated or reduced.

The object of different materials in the wire and in the bath also may be to give the outer coat of the completed wire better properties, for example with respect to corrosion resistance, than of the wire interior. This is a way of reducing material costs. A stainless steel, for example, can be applied to a wire of unalloyed or low alloyed steel.

Substantially different properties of the wire 2 and the cast coat also can be obtained by adjusting the coat thickness and cooling so that the solidification proceeds extremely rapidly. Hereby an amorphous or substantially amorphous structure can be obtained which has extremely good strength properties.

In order to control the outflow of molten metal though the outlet hole, the molten metal, bath, can be subjected to pressure, whereby the outflow can be controlled by controlling the pressure.

The uncoiling reel can be placed on the same level as or below the container for the bath, in such a manner that the wire is passed down into the bath via pulleys or the like. This is a way of holding short the total extension in vertical direction of the apparatus. In a corresponding way the wire, via pulleys or the like, can be passed out horizontally to the coiling reel, where at least a part of the cooling device may consist of a bath or the like in a horizontal groove or the like.

The invention, thus, must not be regarded restricted to the above embodiments of the method and apparatus, but can be varied within the scope of the attached claims.

I claim:

1. A method of manufacturing metallic wire products by direct casting of molten metal, in which the molten metal is in the form of a bath contained in a container having an outlet hole in the bottom thereof through which the metal can flow, the method comprising:

A. passing a stabilizing wire out through the container and the outlet hole, the stabilizing wire being of a metal having substantially the same melting point as the molten metal, wherein the diameter of the outlet hole is substantially greater than, and a minimum of 1.5 times greater than the diameter of the stabilizing wire;

B. flowing freely a jet of said molten metal out of said outlet hole;

C. forming an unbroken wire shaped body of said jet that is stabilized by said stabilizing wire;

D. controlling the rate at which the stabilizing wire is passing out through the outlet hole so that it substantially corresponds to the rate at which said jet is flowing out of the outlet hole;

E. cooling the unbroken jet of molten metal surrounding the stabilizing wire and causing it to solidify around the stabilizing wire, substantially all solidification taking place after the stabilizing wire and molten metal have exited from the outlet hole; and F. collecting the stabilizing wire and solidified surrounding molten metal.

2. The method of claim 1 further including introducing said stabilizing wire into the bath through a pipe made of ceramic or like material, including introducing the stabilizing wire into the pipe at the upper mouth thereof located above the upper surface of the bath, moving the stabilizing wire through the pipe and moving the stabilizing wire out of the pipe at the lower mouth thereof located adjacent said outlet hole.

3. The method of claim 2 further including cooling said stabilizing wire with a coolant, such as liquid argon, during passage of the stabilizing wire through the pipe, and containing the coolant in the pipe.

4. The method of claim 1 wherein the diameter of the outlet hole is 1.5 to 2 times greater than the diameter of the stabilizing wire.

* * * * *